US009293811B2

(12) United States Patent
Kosugi et al.

(10) Patent No.: US 9,293,811 B2
(45) Date of Patent: Mar. 22, 2016

(54) ANTENNA DEVICE

(71) Applicant: KABUSHIKI KAISHA TOKAI RIKA DENKI SEISAKUSHO, Aichi (JP)

(72) Inventors: Masanori Kosugi, Aichi (JP); Katsuhide Kumagai, Aichi (JP)

(73) Assignee: KABUSHIKI KAISHA TOKAI RIKA DENKI SEISAKUSHO, Aichi (JP)

( * ) Notice: Subject to any disclaimer, the term of this patent is extended or adjusted under 35 U.S.C. 154(b) by 226 days.

(21) Appl. No.: 13/948,545

(22) Filed: Jul. 23, 2013

(65) Prior Publication Data

US 2014/0035785 A1 Feb. 6, 2014

(30) Foreign Application Priority Data

Aug. 2, 2012 (JP) ..... 2012-172099

(51) Int. Cl.

| | |
|---|---|
| ***H01Q 1/24*** | (2006.01) |
| ***H01Q 1/32*** | (2006.01) |
| ***H01Q 1/00*** | (2006.01) |

(52) U.S. Cl.

CPC ..... *H01Q 1/32* (2013.01); *H01Q 1/005* (2013.01); *H01Q 1/3241* (2013.01)

(58) Field of Classification Search

CPC ..... H01Q 1/32; H01Q 1/005; H01Q 1/3241
See application file for complete search history.

(56) References Cited

U.S. PATENT DOCUMENTS

| | | | | |
|---|---|---|---|---|
| 6,573,869 | B2 * | 6/2003 | Moore | 343/702 |
| 2003/0189522 | A1 * | 10/2003 | Zeilinger | H01Q 9/0421 343/702 |
| 2004/0075611 | A1 | 4/2004 | Kenoun et al. | |
| 2004/0252062 | A1 * | 12/2004 | Tracy | H01Q 9/0421 343/702 |
| 2005/0146468 | A1 * | 7/2005 | Ghabra | H01Q 1/3241 343/700 MS |
| 2005/0280587 | A1 * | 12/2005 | Svigelj et al. | 343/702 |
| 2007/0290931 | A1 * | 12/2007 | Utagawa | H01Q 1/243 343/700 MS |
| 2008/0284661 | A1 * | 11/2008 | He | 343/700 MS |
| 2012/0007784 | A1 | 1/2012 | Ling et al. | |

FOREIGN PATENT DOCUMENTS

| | | |
|---|---|---|
| JP | 2002-356855 | 12/2002 |
| JP | 2010-161725 | 7/2010 |
| JP | 2011-188365 | 9/2011 |
| JP | 2012-029137 | 2/2012 |

OTHER PUBLICATIONS

Search report from E.P.O., mail date is Oct. 14, 2013.
Japan Office action, mail date is Apr. 14, 2015.

* cited by examiner

*Primary Examiner* — Trinh Dinh
(74) *Attorney, Agent, or Firm* — Greenblum & Bernstein, P.L.C.

(57) ABSTRACT

An antenna device includes an antenna. The antenna includes a plurality of plate-like legs, coupled to a base plate, and a plurality of plate-like arms, supported by the legs. Adjacent ones of the arms are continuous with each other. At least two of the legs have thicknesses in different thickness-wise directions.

9 Claims, 2 Drawing Sheets

ANTENNA DEVICE

CROSS-REFERENCE TO RELATED APPLICATIONS

This application is based upon and claims the benefit of priority from prior Japanese Patent Application No. 2012-172099, filed on Aug. 2, 2012, the entire contents of which are incorporated herein by reference.

FIELD

The present invention relates to an antenna device.

BACKGROUND

A vehicle may include an electronic key system that verifies a wireless signal transmitted from an electronic key to control the locking and unlocking of the vehicle doors and the starting of a drive source. An antenna device that receives wireless signals is arranged in such a vehicle that includes the electronic key system. Japanese Laid-Open Patent Publication No. 2012-29137 describes a reverse-L-shaped antenna fixed to a substrate. The reverse-L-shaped antenna includes a plate-like leg, which extends orthogonal to the upper surface of the substrate, and a plate-like arm, which is continuous with a distal portion of the leg and which extends parallel to the upper surface of the substrate.

The antenna device is often installed in a vehicle door. The vehicle door vibrates when the vehicle travels and when the door opens and closes. The vibration is transmitted from the leg to the arm in the antenna. As described in the publication, the conventional antenna (arm) is formed to have a uniform thickness in one thickness-wise direction. As illustrated in the schematic view of FIG. 5, in the conventional structure, a plate-like antenna 51 is cantilevered by a substrate 52. Thus, the antenna 51 has a tendency to vibrate in the thickness-wise direction. In such a structure, vibration of the vehicle door may cause resonance at the arm of the antenna 51. Consequently, vibrational noise resulting from the resonance of the antenna 51 may be audible to a vehicle occupant.

SUMMARY

One aspect of the present invention is an antenna device including an antenna. The antenna includes a plurality of plate-like legs, coupled to a base plate, and a plurality of plate-like arms, supported by the legs. Adjacent ones of the arms are continuous with each other. At least two of the legs have thicknesses in different thickness-wise directions.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF THE EMBODIMENTS

One embodiment of an antenna device will now be described with reference to FIGS. 1, 2A, and 2B. In the present embodiment, an antenna device 1 is installed in, for example, a vehicle (vehicle door).

Figure 1:
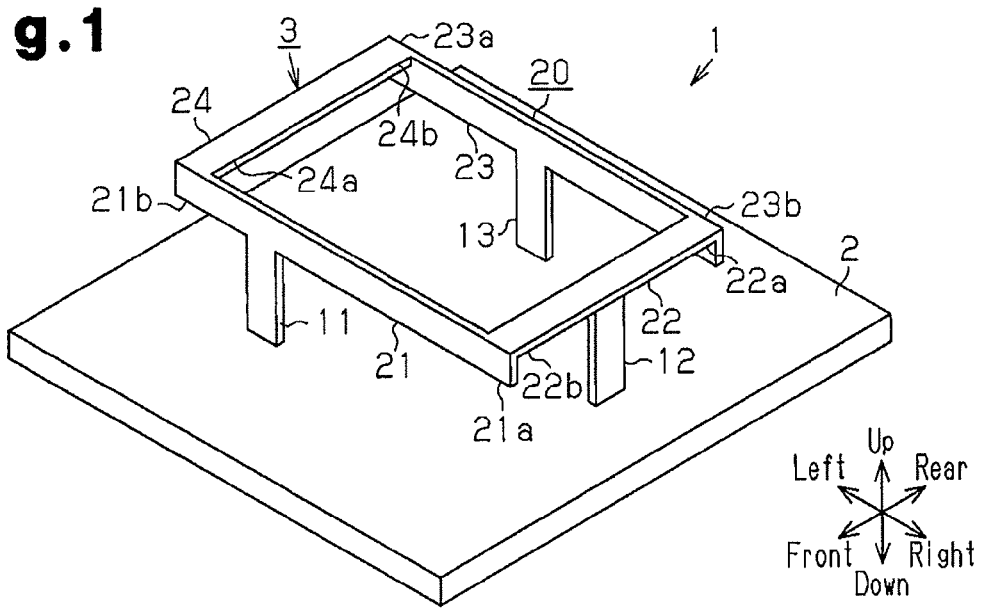
FIG. 1 is a schematic perspective view of the antenna device.

Referring to FIG. 1, the antenna device 1 includes a substrate 2, which serves as a base plate, and an antenna 3 (antenna element), which is coupled to an upper surface of the substrate 2. The antenna 3 receives a wireless signal transmitted from a vehicle electronic key (not illustrated) and sends the received signal to an electronic circuit (not illustrated) in the substrate 2.

The antenna 3 is formed by punching out a metal piece having a predetermined pattern from a sheet of metal plate and then bending the metal piece. The antenna 3 includes a plurality of (three in the present example) legs 11 to 13, extending orthogonal to the substrate 2, and a frame-shaped arm portion 20, supported by the legs 11 to 13. The arm portion 20 includes a plurality of (four in the present example) arms 21 to 24. The legs 11 to 13 and the arms 21 to 24 are plate-like and have a uniform thickness.

The leg 11 extends in the upward direction from the upper surface of the substrate 2. The leg 11 has a thickness in a first direction (front-to-rear direction in FIG. 1) that is parallel to the substrate 2. That is, the thickness-wise direction of the leg 11 is set in the first direction. The leg 11 has a distal portion on which the arm 21 is arranged. The arm 21 extends in a second direction (left-to-right direction in FIG. 1) that is parallel to the substrate 2 and perpendicular to the first direction. Accordingly, the arm 21 is perpendicular to the leg 11. The arm 21 has a thickness in the first direction. That is, the thickness-wise direction of the arm 21 is set in the first direction. As illustrated in FIG. 1, the arm 21 and the leg 11 include continuous front surfaces and continuous rear surfaces. As illustrated in FIG. 2B, the leg 11 and the arm 21 are T-shaped as a whole.

The arm 21 includes a right end 21*a* and a left end 21*b* as illustrated in FIG. 1. The arm 22 is arranged on the right end 21*a* of the arm 21. The arm 22 extends in the first direction (front-to-rear direction) from the right end 21*a* of the arm 21. The arm 22 is continuous with the upper end surface of the arm 21 and extends in the rear direction from the right end 21*a* of the arm 21. Accordingly, the arm 21 and the arm 22 are perpendicular to each other. The arm 22 has a thickness in a third direction (vertical direction, or up-to-down direction in FIG. 1). That is, the thickness-wise direction of arm 22 is set in the third direction. As illustrated in FIG. 2B, the arm 22 and the arm 21 include continuous right end surfaces. As illustrated in FIG. 1, the arm 22 includes a front end 22*b*, which is continuous with the arm 21, and an opposite rear end 22*a*. The leg 12, which extends in the upward direction from the upper surface of the substrate 2, supports the arm 22 between the front end 22*b* and the rear end 22*a*. Accordingly, the arm 22 and the leg 12 are perpendicular to each other. The leg 12 has a thickness in the second direction (left-to-right direction). That is, the thickness-wise direction of the leg 12 is set in the second direction. As illustrated in FIG. 2B, the leg 12 includes a left surface that is continuous with a left end surface of the arm 22. As illustrated in FIG. 1, the leg 12 and the arm 22 are T-shaped as a whole.

As illustrated in FIG. 1, the arm 23 extends in the second direction (left-to-right direction) from the rear end 22*a* of the arm 22. The arm 23 is continuous with an upper surface of the arm 22 and extends in the left direction from the rear end 22*a* of the arm 22. Accordingly, the arm 22 and the arm 23 are perpendicular to each other. The arm 23 has a thickness in the first direction (front-to-rear direction). That is, the thickness-wise direction of the arm 23 is set in the first direction. The arm 23 includes a right end 23*b*, which is continuous with the arm 22, and an opposite left end 23*a*. The leg 13, which extends in the upward direction from the upper surface of the substrate 2, supports the arm 23 between the right end 23*b* and the left end 23*a*. Accordingly, the arm 23 and the leg 13 are perpendicular to each other. The leg 13 has a thickness in the first direction (front-to-rear direction). That is, the thickness-wise direction of the leg 13 is set in the first direction. As illustrated in FIG. 1, the arm 23 and the leg 13 include continuous front surfaces and continuous rear surfaces. As illustrated in FIG. 2B, the leg 13 and the arm 23 are T-shaped as a whole.

As illustrated in FIG. 1, the arm 24 extends from the left end 23*a* of the arm 23 in the first direction (front-to-rear direction). The arm 24 is continuous with the upper end surface of the arm 23 and extends in the front direction from the left end 23*a* of the arm 23. Accordingly, the arm 24 and the arm 23 are perpendicular to each other. The arm 24 has a thickness in the third direction (up-to-down direction). That is, the thickness-wise direction of the arm 24 is set in the third direction. The arm 24 includes a rear end 24*b*, which is continuous with the arm 23, and an opposite front end 24*a*. The front end 24*a* of the arm 24 includes an upper surface that is continuous with the upper end surface of the left end 21*b* of the arm 21. The arm 24 and the arm 21 are perpendicular to each other. The arm 21 and the arm 23 both support the arm 24. As illustrated in FIG. 2B, the arm 24 includes a left end surface that is continuous with a left end surface of the arm 21 and a left end surface of the arm 23.

Figure 2A:
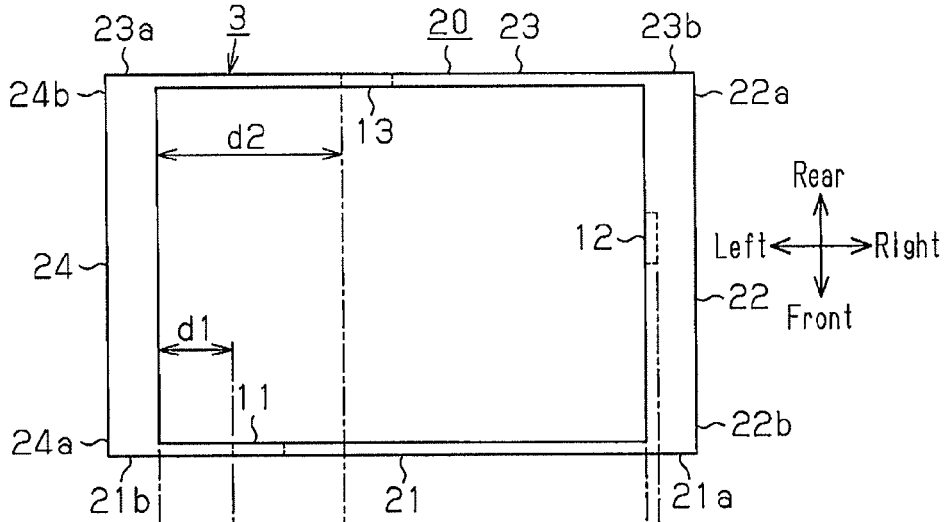
FIG. 2A is a plan view of an antenna illustrated in FIG. 1.
Figure 2B:
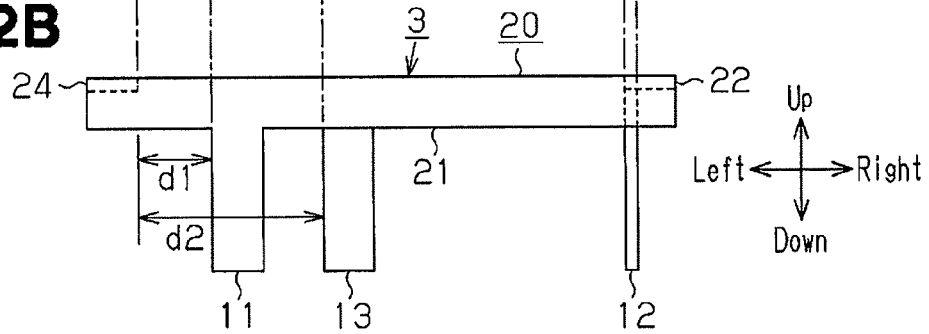
FIG. 2B is a front view of the antenna illustrated in FIG. 1.

As illustrated in FIGS. 2A and 2B, the leg 11 includes a left end surface separated by distance d1 from the right end surface (inner end surface) of the arm 24. Further, the leg 13 includes a left end surface separated by distance d2 from the right end surface of the arm 24. The distances d1 and d2 are set as coprime values.

The operation of the antenna 3 when vibration occurs in the device on which the antenna 3 is arranged, e.g., the vehicle door (not illustrated) in the present embodiment, will now be described. A case in which the substrate 2 vibrates in the first direction (front-to-rear direction) of FIG. 1 will now be described.

A vibrational wave generated by the vibration of the substrate 2 is transmitted to the legs 11 to 13. Under this situation, a plate member having a thickness-wise direction that is the same as the vibrational direction vibrates greatly and easily transmits vibrational waves, whereas a plate member having a thickness-wise direction that differs from the vibrational direction vibrates slightly and subtly transmits vibrational waves. Accordingly, when two plate members having different thickness-wise directions are perpendicular to each other, the transmission of vibrational waves from one plate member to the other plate member is suppressed. Referring to FIG. 2A, the thickness-wise direction of the leg 12 is set in the second direction (left-to-right direction) that differs from the vibrational direction of the substrate 2 (here, the first direction). Accordingly, the leg 12 resists the transmission of vibrational waves. Further, referring to FIG. 2B, the thickness-wise direction of the arm 22, which is continuous with the leg 12, is set in the third direction (up-to-down direction) that differs from the vibrational direction of the substrate 2. Accordingly, the arm 22 also resists the transmission of vibrational waves. This suppresses resonance of the leg 12 and the arm 22.

Referring to FIG. 2A, the thickness-wise direction of each of the legs 11 and 13 is set in the first direction (front-to-rear direction) that is the same as the vibrational direction of the substrate 2 (here, the first direction). Accordingly, the legs 11 and 13 easily transmit vibrational waves. For the same reason, the arm 21, which is continuous with the leg 11, and the arm 23, which is continuous with the leg 13, easily transmit vibrational waves. However, the arms 21 and 23 are perpendicular to the arm 22 at the right ends 21*a* and 23*b*, and the thickness-wise direction of each of the arms 21 and 23 (first direction) differs from the thickness-wise direction of the arm 22 (third direction). Accordingly, vibrational waves are subtly transmitted from the arms 21 and 23 to the arm 22, and resonance of the arm 22 is suppressed. Further, resonance of the arms 21 and 23 is also suppressed at the right side of the legs 11 and 13.

The arms 21 and 23 are continuous with the arm 24 at the left ends 21*b* and 23*a*. Referring to FIGS. 2A and 2B, the left end surface of the leg 11 is separated by distance d1 from the right end surface of the arm 24. The left end surface of the leg 13 is separated by distance d2 from the right end surface of the arm 24. The distances d1 and d2 are set as coprime values. Thus, the wavelength of the vibrational waves transmitted from the arm 21 to the arm 24 differs from the wavelength of the vibrational waves transmitted from the arm 23 to the arm 24. Accordingly, resonance is substantially not generated at the arm 24 where the vibrational waves having different wavelengths are transmitted. This suppresses resonance of the arms 21 and 23 at the left side of the legs 11 and 13. As a result, resonance is suppressed at the arms 21 and 23 as a whole. Thus, resonance is also suppressed at the leg 11, which is continuous with the arm 21, and the leg 13, which is continuous with the arm 23. In this manner, resonance of the antenna 3 is suppressed, and the generation of vibrational noise that would be caused by the resonance is suppressed.

A case in which the substrate 2 vibrates in the second direction (left-to-right direction) of FIG. 1 will now be described.

When the substrate 2 vibrates in the second direction (left-to-right direction), vibrational waves are transmitted to the legs 11 to 13. Referring to FIG. 2A, the thickness-wise direction of each of the legs 11 and 13 is set in the first direction (front-to-rear direction) that differs from the vibrational direction of the substrate 2 (here, the second direction). Thus, the legs 11 and 13 resist the transmission of vibrational waves. Further, referring to FIG. 2B, the thickness-wise direction of each of the arms 21 and 23, which are respectively continuous with the legs 11 and 13, is also set in the first direction (front-to-rear direction). Thus, the arms 21 and 23 resist the transmission of vibrational waves. Accordingly, vibrational waves are subtly transmitted from the legs 11 and 13 to the arms 21 and 23. As a result, resonance is suppressed at the legs 11 and 13 and the arms 21 and 23.

Referring to FIG. 2A, the thickness direction of the leg 12 is set in the second direction (left-to-right direction), which is the same as the vibrational direction of the substrate 2 (here, the second direction). Accordingly, the leg 12 easily transmits vibrational waves. However, the thickness-wise direction of the arm 22, which is continuous with the leg 12, is set in the third direction (up-to-down direction) that differs from the vibrational direction of the substrate 2. Accordingly, the arm 22 resists the transmission of vibrational waves. Further, the arm 22 is perpendicular to the arms 21 and 23 at the front end 22*b* and the rear end 22*a*, and the thickness-wise direction of the arm 22 (third direction) differs from the thickness-wise direction of each of the arms 21 and 23 (first direction). Accordingly, vibrational waves are subtly transmitted from the arm 22 to the arms 21 and 23, and resonance is suppressed at the arms 21 and 23. This suppresses resonance of the leg 12, which is continuous with the arm 22.

Further, the thickness-wise direction of the arm 24 is set in the third direction (up-to-down direction) that differs from the vibrational direction of the substrate 2 (here, the second direction). Accordingly, the arm 24 resists transmission of vibrational waves. The arm 24 is continuous with the arms 21 and 23 where resonance is suppressed. This suppresses resonance of the arm 24. In this manner, resonance of the antenna 3 is suppressed, and the generation of vibrational noise that would be caused by the resonance is suppressed.

A case in which the substrate 2 vibrates in the third direction (up-to-down direction) of FIG. 1 will now be described.

When the substrate 2 vibrates in the third direction (up-to-down direction), vibrational waves are transmitted to the legs 11 to 13. Referring to FIG. 2A, the thickness-wise direction of each of the legs 11 and 13 is set in the first direction (front-to-rear direction) that differs from the vibrational direction of the substrate 2 (here, the third direction). Thus, the legs 11 and 13 resist the transmission of vibrational waves. Further, referring to FIG. 2B, the thickness-wise direction of each of the arms 21 and 23, which are respectively continuous with the legs 11 and 13, is also set in the first direction (front-to-rear direction). Thus, the arms 21 and 23 also resist the transmission of vibrational waves. Accordingly, vibrational waves are subtly transmitted from the legs 11 and 13 to the arms 21 and 23. As a result, resonance is suppressed at the legs 11 and 13 and the arms 21 and 23.

Referring to FIG. 2A, the thickness direction of the leg 12 is set in the second direction (left-to-right direction), which differs from the vibrational direction of the substrate 2 (here, the third direction). Accordingly, the leg 12 resists the transmission of vibrational waves. In contrast, the thickness-wise direction of the arm 22, which is continuous with the leg 12, is set in the third direction (up-to-down direction), which is the same as the vibrational direction of the substrate 2. Accordingly, the arm 22 easily transmits vibrational waves. However, the arm 22 is continuous with the arms 21 and 23, which subtly transmit the vibrational waves, at the front end 22*b* and the rear end 22*a*. This suppresses resonance of the arm 22.

The thickness-wise direction of the arm 24 is set in the third direction (up-to-down direction), which is the same as the vibrational direction of the substrate 2 (here, the third direction). Accordingly, the arm 24 easily transmits vibrational waves. However, the arm 24 is perpendicular to the arms 21 and 23 at the front end 24*a* and the rear end 24*b*. The thickness-wise direction of each of the arms 21 and 23 is set in the first direction. This suppresses resonance of the arms 21 and 23. Thus, resonance is also suppressed at the arm 24, which is continuous with the arms 21 and 23. Further, as illustrated in FIGS. 2A and 2B, the left end surface of the leg 11 is separated by distance d1 from the right end surface of the arm 24, and the left end surface of the leg 13 is separated by distance d2 from the right end surface of the arm 24. The distances d1 and d2 are set as coprime values. Thus, the wavelength of the vibrational waves transmitted from the arm 21 to the arm 24 differs from the wavelength of the vibrational waves transmitted from the arm 23 to the arm 24. Accordingly, resonance is substantially not generated at the arm 24 where vibrational waves having difference wavelengths are transmitted. In this manner, resonance of the antenna 3 is suppressed, and the generation of vibrational noise that would be caused by the resonance is suppressed.

The present embodiment has the advantages described below.

(1) The antenna 3 includes the plate-like legs 11 to 13 and the plate-like arms 21 to 24. The thickness-wise direction of each of the legs 11 and 13 and the arms 21 and 23 is set in the first direction (front-to-rear direction in FIG. 1). The thickness-wise direction of the leg 12 is set in the second direction (left-to-right direction in FIG. 1) that differs from the first direction. The thickness-wise direction of each of the arms 22 and 24 is set in the third direction (up-to-down direction in FIG. 1) that differs from the first and second directions. The plate-like members easily transmit vibrational waves when vibrated in the same direction as the thickness-wise direction, and resist the transmission of vibrational waves when vibrated in a direction differing from the thickness-wise direction. In the antenna 3, the thickness-wise direction of the legs 11 and 13 differs from the thickness-wise direction of the leg 12. Accordingly, the legs 11 and 13 or the leg 12 suppresses the transmission of vibration to the arms 21 to 24. Additionally, the thickness-wise direction of each of the arms 21 and 23 differs from the thickness-wise direction of each of the arms 22 and 24. Accordingly, the arms 21 and 23 or the arms 22 and 24 suppress the transmission of vibration between the arms 21 to 24. In this manner, the antenna 3 includes legs and arms that suppress the transmission of vibrational waves regardless of the vibrational direction of the antenna 3. Thus, the antenna 3 resists resonance regardless of the direction of vibration, and the generation of vibrational noise that would be caused by the resonance of the antenna 3 is suppressed.

(2) The arms 21 and 23 are perpendicular to the arms 22 and 24. When plate-like members having different thickness-wise directions are perpendicular to each other, the transmission of vibrational waves between the plate-like members is further effectively suppressed. This further effectively suppresses the generation of vibrational noise that would be caused by the resonance of the antenna 3.

(3) The left end surface of the leg 11 is separated by distance d1 from the right end surface of the arm 24. Further, the left end surface of the leg 13 is separated by distance d2 from the right end surface of the arm 24. The distance d1 and the distance d2 are set as coprime values. As a result, when vibration of the substrate 2 transmits vibrational waves to the arms 21 and 23, vibrational waves having different wavelengths are transmitted from the arms 21 and 23 to the arm 24, which is supported from two sides by the arms 21 and 23. Thus, resonance is suppressed at the arm 24, and the generation of vibrational noise caused by the resonance of the antenna 3 is suppressed.

It should be apparent to those skilled in the art that the present invention may be embodied in many other specific forms without departing from the spirit or scope of the invention. Particularly, it should be understood that the present invention may be embodied in the following forms.

Figure 3:
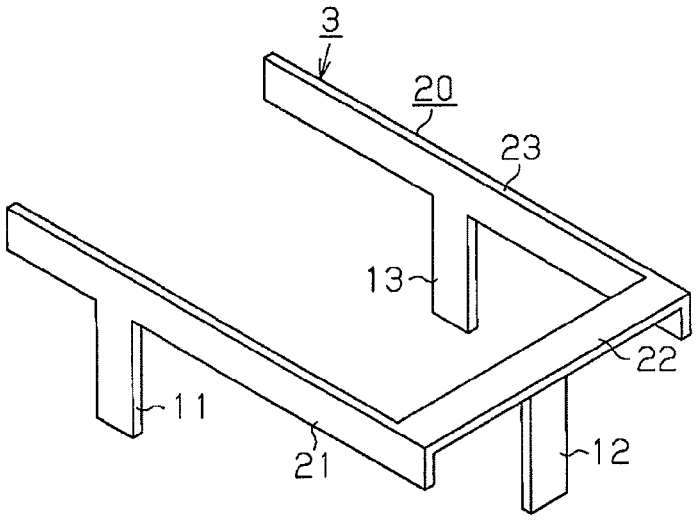
FIG. 3 is a schematic perspective view illustrating another example of an antenna.

In the above embodiment, the arm 24 may be omitted. In this case, as illustrated in FIG. 3, the arm portion 20 is C-shaped or U-shaped as viewed from above. Further, although not illustrated in the drawings, in the above embodiment, the leg 12 and the arm 22 may be omitted. That is, the arm portion 20 does not have to be frame-shaped. Further, although not illustrated in the drawings, in the above embodiment, the arm 24 and the leg 11 may be omitted. Alternatively, the arm 24 and the leg 13 may be omitted. Further, in the above embodiment, the leg 11 and the arms 21 and 24 may be omitted. Alternatively, the leg 13 and the arms 23 and 24 may be omitted. In this structure, the arm portion 20 is L-shaped as viewed from above. In other words, the antenna 3 only needs to include two or more legs and two or more arms. Such a structure also obtains advantages (1) and (2).

In the above embodiment, a leg extending in the upward direction from the upper surface of the substrate 2 may support the arm 24. In this case, the arm portion 20 is supported by four legs. That is, the arm portion 20 only needs to be supported by a plurality of legs having different thickness-wise directions. Such a structure also includes the same advantages as the above embodiment.

Figure 4:
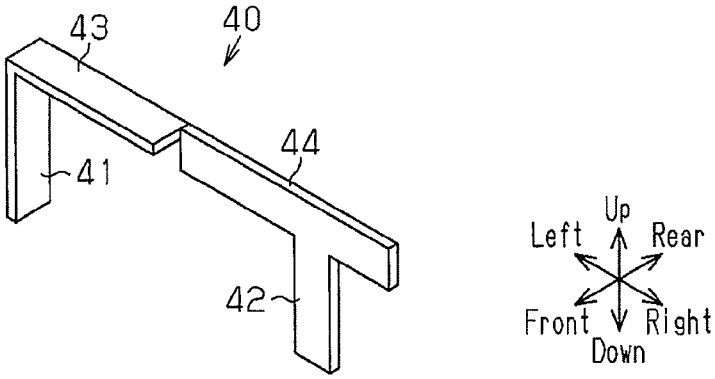
FIG. 4 is a schematic perspective view illustrating a further example of an antenna.
Figure 5:
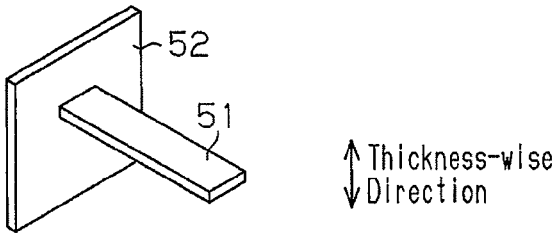
Fig.5(Related Art)
FIG. 5 is a schematic perspective view illustrating a conventional plate-like antenna that is cantilevered.

In the above embodiment, adjacent ones of the arms 21 to 24 are perpendicular to each other but do not necessarily have to be perpendicular. For example, as illustrated in FIG. 4, an antenna 40 may include two legs 41 and 42, extending in the upward direction from the upper surface of a substrate (not illustrated), and two arms 43 and 44, respectively arranged on distal portions of the legs 41 and 42. The thickness-wise direction of the leg 41 is set in a first direction (for example, left-to-right direction). The thickness-wise direction of the leg 42 is set in the second direction (for example, front-to-rear direction) that differs from the first direction. The arm 43 extends in the first direction (left-to-right direction). The thickness-wise direction of the arm 43 is set in the third direction (for example, up-to-down direction) that differs from the first and second directions. The arm 44 extends in the first direction (left-to-right direction). The thickness-wise direction of the arm 44 is set in the second direction (front-to-rear direction). As illustrated in FIG. 4, the arm 44 has a left end that is continuous with a right end of the arm 43. In such a structure, when vibration is produced in the front-to-rear direction and the up-to-down direction, the leg 41 suppresses the transmission of vibrational waves. Further, when vibration is produced in the left-to-right direction and the up-to-down direction, the leg 42 suppresses the transmission of vibrational waves. When vibration is produced in the front-to-rear direction and the left-to-right direction, the arm 43 suppresses the transmission of vibrational waves. When vibration is produced in the left-to-right direction and the up-to-down direction, the arm 44 suppresses the transmission of vibrational waves. In this manner, the antenna 40 includes legs and arms that suppress the transmission of vibrational waves regardless of the vibrational direction of the antenna 40. Thus, the antenna 40 resists resonance regardless of the direction of vibration. This suppresses the generation of vibrational noise caused by resonance of the antenna 40.

In the above embodiment, the width of the arms 21 and 23 (i.e., length in the up-to-down direction) may be decreased to increase the distance from the upper surface of the substrate 2 to the lower end surfaces of the arms 21 and 23. In such a structure, the gain of the antenna 3 may be increased without changing the height of the antenna 3 from the upper surface of the substrate 2.

In the above embodiment, each of the legs 11 to 13 and the arms 21 to 24 includes an end surface that is continuous with the end surface of the adjacent member (adjacent arm or leg). However, for example, like the arms 43 and 44 of FIG. 4, two adjacent members only need to be continuous with each other, and the end surfaces of two adjacent members do not necessarily have to be continuous.

In the above embodiment, the thickness-wise direction of each of the legs 11 to 13 and the arms 21 to 24 is set to be orthogonal or parallel to the upper surface of the substrate 2, but may be set in the other direction. That is, the legs 11 to 13 and the arms 21 to 24 only need to be arranged so that two adjacent members (adjacent arms, or adjacent arm and leg) have different thickness-wise directions.

In the above embodiment, the legs 11 to 13 and the arms 21 to 24 are plate members having rectangular cross-sections but may be plate-like members having elliptic cross-sections. Even in such a case, each of the legs and arms also has a thickness-wise direction. Thus, the same advantages as the above embodiment are obtained.

In the above embodiment, the antenna device 1 is arranged in a vehicle door but may be arranged at any location in the vehicle. Further, the antenna device 1 may be arranged in an apparatus other than a vehicle. For example, the antenna devices 1 of the above embodiment and modifications may be used as any antenna device attached to any apparatus that may vibrate, such as a door of a building.

The present examples and embodiments are to be considered as illustrative and not restrictive, and the invention is not to be limited to the details given herein, but may be modified within the scope and equivalence of the appended claims.

The invention claimed is:

1. An antenna device comprising:

an antenna including:

a plurality of plate-like legs coupled to a base plate, and a plurality of plate-like arms supported by the plurality of legs, wherein adjacent arms of the plurality of arms are continuous with each other, wherein at least two of the plurality of legs have thicknesses in different thickness-wise directions, wherein the plurality of plate-like arms include:

at least one first arm, each first arm of the at least one first arm having a thickness only in a direction substantially parallel to the base plate, and extending in a single direction in a plane parallel to the base plate, and at least one second arm, each second arm of the at least one second arm having a thickness only in a direction substantially perpendicular to the base plate, and extending in a single direction in the plane parallel to the base plate, wherein each of the at least one first arm is directly connected only to the at least one second arm of the plurality of arms, and does not contact another arm of the at least one first arm, and wherein each of the at least one second arm is directly connected only to the at least one first arm of the plurality of arms, and does not contact another arm of the at least one second arm.

2. The antenna device according to claim 1, wherein a second arm of the at least one second arm is directly connected to and supported by a first leg of the plurality of legs, and the thickness-wise direction of the second arm of the at least one second arm differs from the thickness-wise direction of the first leg of the plurality of legs.

3. The antenna device according to claim 2, wherein the thickness-wise direction of the second arm is perpendicular to the thickness-wise direction of the first leg.

4. The antenna device according to claim 1, wherein the thickness-wise direction of the at least one first arm is perpendicular to the thickness-wise direction of the at least one second arm.

5. The antenna device according to claim 1, wherein the plurality of legs include a first leg and a second leg, the at least one first arm includes a first side arm, which is continuous with the first leg, and a second side arm, which is continuous with the second leg, the at least one second arm includes a middle arm, which is supported from two sides by the first and second side arms, and a distance from the middle arm to the first leg and a distance from the middle arm to the second leg are set as coprime values.

6. The antenna device according to claim 1, wherein the plurality of legs include a first leg having a thickness-wise direction in a first direction that extends parallel to the base plate, and a second leg having a thickness-wise direction in a second direction that extends parallel to the base plate and differs from the first direction, the at least one first arm includes an arm continuous with the first leg and having a thickness-wise direction in the first direction, and the at least one second arm includes an arm continuous with the second leg and having a thickness-wise direction in a third direction that differs from the first and second directions.

7. The antenna device according to claim 1, the thickness of each of the plurality of plate-like arms is a smallest dimension of each of the plurality of plate-like arms.

8. An antenna device comprising:

an antenna including:

a plurality of plate-like legs coupled to a base plate, and a plurality of plate-like arms supported by the legs, wherein at least two of the legs have thicknesses in different thickness-wise directions, wherein the plurality of plate-like arms include:

at least one first arm, each arm of the at least one first arm having a thickness in a direction making a first angle with respect to the base plate, and extending in a single direction in a plane parallel to the base plate, and at least one second arm, each arm of the at least one second arm having a thickness in a direction making a second angle with respect to the base plate, and extending in a single direction in the plane parallel to the base plate, the first angle is different from the second angle, wherein each arm of the at least one first arm contacts at least one of the at least one second arm, and does not contact another arm of the at least one first arm, and each arm of the at least one second arm contacts at least one of the at least one first arm, and does not contact another arm of the at least one second arm.

9. The antenna device according to claim 8, wherein the first angle is generally parallel to the base plate, and the second angle is generally perpendicular to the base plate.

* * * * *